US008050612B2

(12) United States Patent
Kinouchi et al.

(10) Patent No.: US 8,050,612 B2
(45) Date of Patent: Nov. 1, 2011

(54) FIXING DEVICE HAVING A TEMPERATURE-UNIFORMING ROLLER

(75) Inventors: Satoshi Kinouchi, Tokyo (JP); Osamu Takagi, Chofu (JP); Mitsuaki Kouyama, Higashikurume (JP); Kazuhiko Kikuchi, Kanagawa-ken (JP); Toshihiro Sone, Kanagawa-ken (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 107 days.

(21) Appl. No.: 12/501,143

(22) Filed: Jul. 10, 2009

(65) Prior Publication Data

US 2010/0014899 A1 Jan. 21, 2010

Related U.S. Application Data

(60) Provisional application No. 61/104,206, filed on Oct. 9, 2008, provisional application No. 61/081,688, filed on Jul. 17, 2008.

(51) Int. Cl.
*G03G 15/20* (2006.01)

(52) U.S. Cl. ..... 399/333; 399/328

(58) Field of Classification Search ..... 219/216; 399/328–330, 333
See application file for complete search history.

(56) References Cited

U.S. PATENT DOCUMENTS

| | | | | |
|---|---|---|---|---|
| 6,026,273 | A | 2/2000 | Kinouchi | |
| 7,558,520 | B2 * | 7/2009 | Sugawara et al. | 399/333 |
| 2009/0080954 | A1 * | 3/2009 | Miyata et al. | 399/329 |

FOREIGN PATENT DOCUMENTS

| | | |
|---|---|---|
| JP | 8-278713 | 10/1996 |
| JP | 9-104964 | 4/1997 |
| JP | 2005-183122 | 7/2005 |

OTHER PUBLICATIONS

U.S. Appl. No. 11/078,725.

* cited by examiner

*Primary Examiner* — Hoang Ngo
(74) *Attorney, Agent, or Firm* — Patterson & Sheridan, LLP

(57) ABSTRACT

A technique of reducing temperature unevenness in a heating member which heats a heating target member while reducing heat capacity of the heating member in a fixing device for an image forming apparatus is provided. The fixing device has a heating member having diamond fine particles dispersed and contained at least in its surface layer, a pressurizing member which is pressed in contact with the heating member and nips and carries a sheet in collaboration with the heating member, and a heating unit which heats the heating member.

14 Claims, 12 Drawing Sheets

FIG. 2

| | SHEET PASSING SECTION (℃) | NON-PASSING SECTION (℃) | TEMPERATURE DIFFERENCE (℃) | FIXING CAPABILITY |
|---|---|---|---|---|
| CONVENTIONAL RELEASE LAYER | 160 | 200 | 40 | × |
| RELEASE LAYER OF THIS EMBODIMENT | 160 | 180 | 20 | ○ |

FIG. 3

| | ROLLER TEMPERATURE IMMEDIATELY BEFORE SHEET PASSAGE (℃) | ROLLER TEMPERATURE AFTER SHEET PASSAGE (IMMEDIATELY BEFORE NIP) (℃) | TEMPERATURE DIFFERENCE (℃) | UNEVEN GLOSS |
|---|---|---|---|---|
| CONVENTIONAL RELEASE LAYER | 160 | 153 | 7 | △ |
| RELEASE LAYER OF THIS EMBODIMENT | 160 | 158 | 2 | ○ |

FIG. 7

| | ROLLER TEMPERATURE IMMEDIATELY BEFORE SHEET PASSAGE (℃) | ROLLER TEMPERATURE AFTER SHEET PASSAGE (IMMEDIATELY BEFORE NIP) (℃) | TEMPERATURE DIFFERENCE (℃) | UNEVEN GLOSS |
|---|---|---|---|---|
| CONVENTIONAL RELEASE LAYER | 160 | 150 | 10 | △ |
| RELEASE LAYER OF THIS EMBODIMENT | 160 | 157 | 3 | ○ |

FIXING DEVICE HAVING A TEMPERATURE-UNIFORMING ROLLER

CROSS-REFERENCE TO RELATED APPLICATION

This application is based upon and claims the benefit of priority from: U.S. provisional application 61/104,206, filed on Oct. 9, 2008; and U.S. provisional application 61/081,688, filed on Jul. 17, 2008, the entire contents of each of which are incorporated herein by reference.

TECHNICAL FIELD

The present invention relates to a fixing device in an image forming apparatus and particularly to a technique of reducing unevenness in temperature of heating member which heats a sheet as a heating target member in the fixing device.

BACKGROUND

Conventionally, on a fixing roller, a fixing belt and the like in a fixing device, a release layer to prevent toner from adhering to the fixing roller or the like, and an elastic layer to adjust flexibility of the surface of the fixing roller or the like are formed.

The release layer and the like mainly use a resin as their material. However, a resin usually has a lower thermal conductivity than a metal or the like. Therefore, if temperature varies in the release layer or the like constituting the surface of the fixing roller or the like, it takes time to solve this unevenness. If toner is fixed in the state where temperature is varied in the circumferential direction or the axial direction of the fixing roller or the like, it causes uneven gloss and uneven color of the fixed toner.

The unevenness in temperature of the fixing roller or the like becomes conspicuous particularly if a heating member of the fixing roller or the like having a small heat capacity is used in order to cope with energy-saving. That is, if the heating member has a small heat capacity, for example, when a sheet of paper or the like passes through a nip part of the fixing roller or the like, the surface temperature of the fixing roller or the like is immediately lowered. However, since the release layer and the elastic layer have a low thermal conductivity and it takes time to raise their temperature, fixing is carried out without recovering the initial temperature. If this happens, temperature is consequently varied at the time of fixing. In this manner, if the temperature of the fixing roller or the like that is necessary for fixing toner is not recovered at the time of pressure contact and the roller surface has temperature unevenness, toner fixing capability is lowered. However, a predetermined heat capacity is necessary to maintain the fixing capability. Thus, it is difficult to realize both further reduction in heat capacity of the fixing member and reduction in temperature unevenness.

SUMMARY

An object of an aspect of the invention is to provide a technique of reducing heat capacity of a heating member which heats a heating target member while reducing temperature unevenness of the heating member in a fixing device of an image forming apparatus.

A fixing device according to an aspect of the invention includes a heating member having diamond fine particles dispersed and contained at least in its surface layer, a pressurizing member which is pressed in contact with the heating member and nips and carries a sheet in collaboration with the heating member, and a heating unit which heats the heating member.

The fixing device further includes a temperature-uniforming member which has diamond fine particles dispersed and contained in its surface layer contacting the heating member and which reduces temperature unevenness of the heating member.

The surface layer of the temperature-uniforming member is formed by dispersing diamond fine particles with an average particle diameter of 0.1 μm or greater and 500 nm or smaller into a fluorine resin.

A fixing device according to another aspect of the invention includes a temperature-uniforming roller having a diamond-like carbon layer on its surface, an endless fixing belt which is wound on plural rollers including the temperature-uniforming roller and has its belt surface moved by rotation of the plural rollers, a pressurizing roller which is pressed in contact with the belt surface of the fixing belt and nips and carries a sheet in collaboration with the belt surface, and a heating unit which heats the fixing belt.

DESCRIPTION OF THE DRAWINGS

FIG. 2 shows the results of measuring the temperature of a release layer between a sheet passing section and a non-passing section where sheets are continuously passed.

FIG. 3 shows the results of measuring the temperature of a release layer immediately before sheet passage and the temperature of the release layer at a position immediately before the sheet reaches a nip part again after sheet passage.

FIG. 7 shows the results of measuring the temperature of a release layer immediately before sheet passage and the temperature of the release layer immediately before the sheet reaches a nip part again after sheet passage.

DETAILED DESCRIPTION

Hereinafter, embodiments of the invention will be described with reference to the drawings.

First Embodiment

Figure 1:
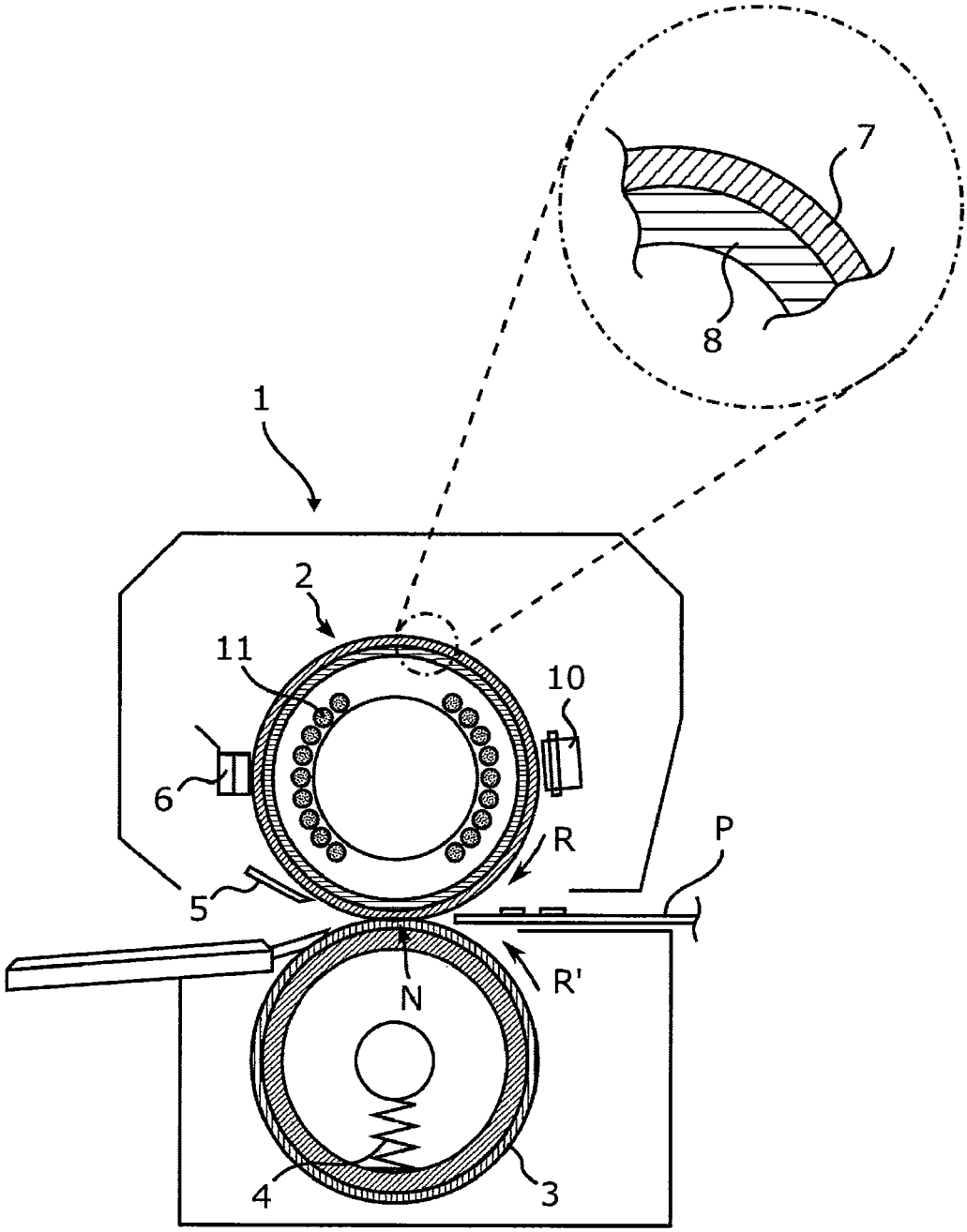
FIG. 1 is a sectional view of a fixing device provided in an image forming apparatus according to a first embodiment.

FIG. 1 is a sectional view of a fixing device 1 provided in an image forming apparatus according to a first embodiment.

The fixing device 1 is a device for fixing toner formed on a sheet P, for example, paper or OHP sheet, to the sheet P as a heating target member by heat.

The fixing device 1 has a fixing roller 2 as a heating member, a pressurizing roller 3 as a pressurizing member, a separator pawl 5, a thermistor 6 as a contact-type temperature sensor, a thermostat 10, an exciting coil 11 as a heating unit, and so on. In this fixing device 1, the sheet P having unfixed toner adhering to its surface is passed through a nip part N where the fixing roller 2 rotationally driven in the direction of arrow R by a driving motor, not shown, contacts the pressurizing roller 3 following the fixing roller 2 to rotate in the direction of arrow R'. Thus, the toner is melted and pressed against the sheet P, and an image can be fixed to the sheet P.

Hereinafter, the configuration of each part of the fixing device 1 will be described.

The fixing roller 2 is a heating member for melting toner, as described above. When the sheet P is passed, the fixing roller 2 is heated to a predetermined temperature in order to melt the toner. The fixing roller 2 is also rotationally driven in the direction of arrow R by a driving motor, not shown, as described above. The fixing roller 2 in this embodiment includes a release layer 7 stacked on the outer surface of a core metal 8. The diameter of the fixing roller 2 is, for example, 30 mm.

The core metal 8 is a cylindrical member made of iron with a thickness of 0.5 mm. Other than iron, its material may be stainless steel, aluminum, or a composite material of stainless steel and aluminum. A magnetic flux generated in the exciting coil 11 as an induction heating device, which will be described later, generates an eddy-current on the core metal 8. The core metal 8 thus generates heat by electric resistance. As the core metal 8 generates heat, the fixing roller 2 is heated.

The release layer 7 is a releasable layer which prevents toner from adhering to the fixing roller 2 and fixes the toner to the sheet. The release layer 7 in this embodiment is formed by dispersing diamond fine particles into a fluorine resin such as PFA (tetrafluoroethylene perfluoro alkyl vinyl ether copolymer) or PTFE (polytetrafluoroethylene).

The release layer 7 in this embodiment has a thickness of 5 μm. The diamond fine particles added to the fluorine resin have an average particle diameter of about 300 nm and are dispersed at a rate of 3 wt % into the release layer 7. Here, in this embodiment, the maximum diameter of each diamond fine particle is referred to as a particle diameter. An average particle diameter is a value found by picking up an image of diamond fine particles via an electron microscope, then randomly extracting 500 diamond fine particles from the picked-up image and calculating the average value of the particle diameters of the extracted diamond fine particles.

As the diamond fine particles are dispersed into the release layer 7, the wear resistance of the release layer 7 can be improved. A conventional release layer made only of a fluorine resin has low wear resistance and therefore gradually becomes worn by friction with the thermistor 6 as the contact-type temperature detection unit and by friction with the passing sheet P. Therefore, the conventional release layer needs a thickness of approximately 20 μm to 50 μm in order to secure the life of the fixing roller. On the other hand, the thickness of the release layer 7 in this embodiment can be 5 μm with the improved wear resistance. Since the thickness of the release layer 7 can be made thinner to 5 μm, the heat capacity of the release layer 7 can be reduced.

Moreover, the thermal conductivity of diamond is 2000 W/K to 3300 W/K, which is higher than the thermal conductivity of an ordinary fluorine resin. Therefore, as diamond fine particles are dispersed in the release layer 7, the thermal conductivity of the release layer 7 can be significantly improved. Since the thermal conductivity can be improved and the heat capacity can be reduced, temperature unevenness of the release layer 7 in the axial direction of the fixing roller 2 and temperature unevenness of the release layer 7 in the circumferential direction can be restrained.

Now, in order to evaluate the generation of temperature difference in the axial direction of the fixing roller, FIG. 2 shows the results of measuring the temperature at a sheet passing section and a non-passing section when A4-R sheets are continuously passed, using the fixing roller 2 in this embodiment and a conventional fixing roller in which diamond fine particles are not dispersed.

As shown in FIG. 2, in the case of the fixing roller 2 in this embodiment, the temperature rise in the non-passing section with respect to the sheet passing section is restrained to approximately 20° C. On the other hand, in the case of the conventional fixing roller, the temperature difference is 40° C. If the sheet P is passed and fixing is carried out in the state where there is a temperature difference exceeding 20° C. in the axial direction of the fixing roller, difference in gloss of the fixed toner, and if it is color toner, uneven color, may be generated between a high-temperature fixing part and a low-temperature fixing part, which is not preferable. Conventionally, to solve such temperature difference, the output of the heat source for heating the fixing roller 2 need to be changed between the high-temperature part and the low-temperature part of the roller, or a temperature-uniforming heat pipe or the like need to be provided. However, according to this embodiment, since the temperature difference is restrained, such arrangement is not necessary.

FIG. 3 shows the results of measuring the temperature of the release layer immediately before sheet passage and the temperature of the release layer at a position immediately before the sheet reaches the nip part again after sheet passage, in order to evaluate the temperature recovery performance in the circumferential direction with respect to the fixing roller 2 in this embodiment and a fixing roller having a conventional release layer (made only of a fluorine resin with a thickness of 30 μm).

As shown in FIG. 3, in the case of the release layer 7 of this embodiment, the fall from the temperature immediately before sheet passage to the temperature immediately before the sheet is passed again after the sheet is passed once is 2° C. Meanwhile, in the case of the conventional release layer, the temperature fall is 7° C. Therefore, in the case of this embodiment, it can be seen that temperature recovery after sheet passage is quick and that the temperature unevenness in the circumferential direction of the fixing roller 2 is small. If there is a large temperature fall in the circumferential direction, and for example, if toner is fixed to a single sheet in two turns of the fixing roller, the toner is fixed at a high temperature in the first turn but the toner is fixed at a low temperature in the second turn. If there is such temperature unevenness, gloss difference and uneven color of the fixed toner occur in the single sheet. With the release layer 7 of this embodiment, the temperature unevenness in the circumferential direction can be reduced and therefore uneven gloss and uneven color of the toner do not occur.

In this manner, as diamond is dispersed in the release layer 7, its wear resistance can be improved and its thermal conductivity can be improved as well. Moreover, since the improvement in wear resistance enables reduction in the thickness of the release layer 7, the heat capacity of the release layer 7 can be reduced. Thus, warm-up time can be reduced as well.

Moreover, since the release layer 7 has the improved heat conductivity and the reduced thickness, the heat resistance of the release layer 7 is reduced. Thus, heat is quickly transmitted from the core metal 8 to the surface of the release layer 7, and even if the temperature of the release layer 7 is lowered, the temperature necessary for fixing can be recovered immediately. Thus, uneven temperature distribution in the axial direction of the fixing roller 2 and uneven temperature distribution in the circumferential direction can be improved. As the temperature unevenness is eliminated, uneven gloss or uneven color of the toner fixed to the sheet P does not occur and the image quality of the formed image can be improved.

It is preferable that diamond fine particles are added to the release layer 7 within a range of 0.02 wt % to 60 wt %. If the quantity of dispersed diamond fine particles is increased, the heat conductivity of the release layer 7 is improved but the release layer 7 becomes fragile. Therefore, it is preferable that diamond fine particles are dispersed at a rate not exceeding 60 wt %. However, if the fragility can be solved by the use of a binder or the like, it is possible to increase the quantity of dispersed diamond fine particles and thus further improve wear resistance. If the quantity of dispersed diamond fine particles is smaller than 0.02 wt %, the effect of improving wear resistance is small and this prevents formation of a thin release layer 7, which is not preferable.

It is also preferable that the average particle diameter of diamond fine particles be 0.1 nm or greater and 500 nm or smaller. Diamond fine particles with diameters out of this range cannot be uniformly dispersed and are not preferable in terms of operability.

It is also preferable that the thickness of the release layer 7 is 3 μm or greater and 10 μm or smaller. If it is less than 3 μm, it is difficult to form a layer with a uniform thickness. If it is more than 10 μm, the heat capacity of the release layer 7 is increased.

Next, the pressurizing roller 3 is pressed in contact with the fixing roller 2 by a pressurizing mechanism 4, with a predetermined nip width maintained between the pressurizing roller 3 and the fixing roller 2. The pressurizing roller 3 thus nips and carries the sheet P in collaboration with the fixing roller 2. The pressurizing roller 3 follows the fixing roller 2 which is rotationally driven, and rotates in the direction of arrow R'. As the sheet P is passed through the nip part N between the pressurizing roller 3 and the fixing roller 2, the pressurizing roller 3 causes toner melted on the sheet P to be press-bonded and fixed to the sheet P.

The pressurizing roller 3 in this embodiment has a diameter of 30 mm and includes a core metal having its circumference coated with a silicone rubber or fluorine rubber. The silicone rubber or fluorine rubber layer functions as an elastic layer. As this layer is pressed in contact with the fixing roller 2, the roller surface is deformed to form a predetermined nip width. Thus, heat of the fixing roller is securely transmitted to the toner on the passing sheet P and satisfactory fixing is carried out.

Next, the exciting coil 11 is an induction heating device for heating the fixing roller 2. The exciting coil 11 is arranged on the inner circumference of the fixing roller 2. As a high-frequency alternating current is applied to the exiting coil 11 from an exciting circuit, not shown, a magnetic flux is generated and this magnetic flux generates an eddy-current in the core metal 8 of the fixing roller 2. The core metal 8, in which the eddy-current is generated, generates heat by its electric resistance and thus heats the fixing roller 2.

The exciting coil 11 in this embodiment includes a Litz wire, which is a bundle of plural copper wires each having a diameter of 0.5 mm coated with an insulating film and thus being insulated from each other. As a Litz wire is used, the diameter of the coil wires can be made smaller than the penetration depth of the current and the AC current can effectively be applied. As the material of the insulating film, heat-resistant polyamideimide is used. A high-frequency current within a range of 20 to 100 kHz can be applied to the exciting coil 11. Moreover, by adjusting the driving frequency of the exciting circuit, it is possible to adjust the output within a range of 300 W to 1500 W.

The exciting coil 11 as the induction heating device in this embodiment does not use a core member for concentrating the magnetic flux of the coil. The exciting coil 11 is a coreless coil. As the coreless coil is used, it is not necessary to use any core member of a complex shape and therefore the cost can be reduced. The exciting circuit can be inexpensive.

Next, the configuration of the other units will be described. The separator pawl 5 is a member that is arranged downstream in the rotating direction R from the nip part N between the fixing roller 2 and the pressurizing roller 3 and separates the sheet P from the fixing roller 2. The thermistor 6 is arranged downstream from the nip part in the rotating direction R of the fixing roller 2 and to the side of the fixing roller 2. The thermistor 6 detects the temperature of the fixing roller 2. The thermostat 10 is a device that is arranged upstream from the nip part in the rotating direction R of the fixing roller 2 and detects temperature anomaly of the fixing roller 2.

Figure 4:
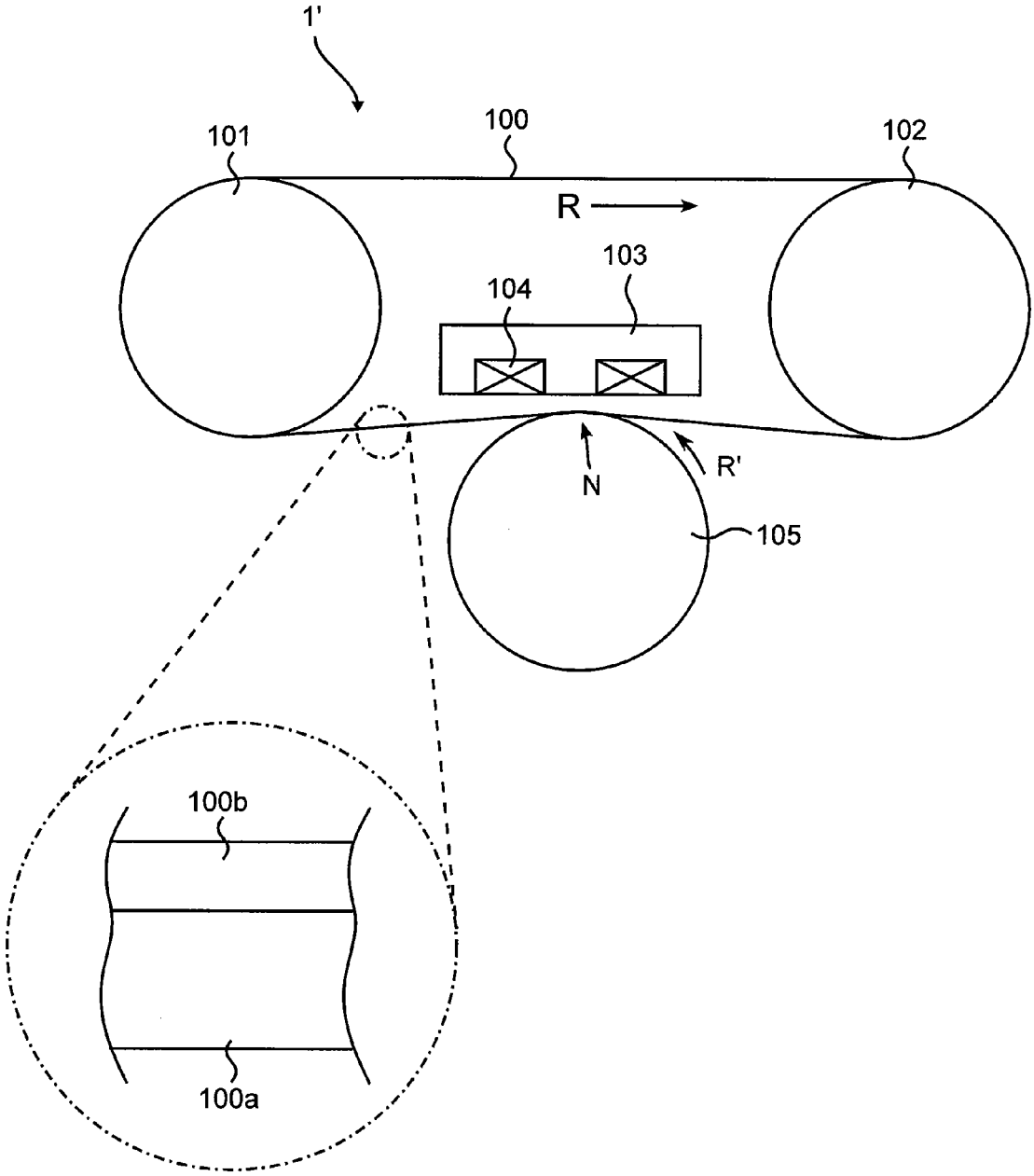
FIG. 4 is a sectional view of a fixing device according to a modification of the first embodiment.

Next, a modification of the first embodiment will be described with reference to FIG. 4. FIG. 4 is a sectional view of a fixing device 1' as a modification of the first embodiment. The fixing device 1' shown in FIG. 4 differs from the fixing device 1 of the first embodiment in that toner is fixed by a fixing belt 100 as an endless belt and a pressurizing roller 105. The fixing belt 100 has a release layer 100*a* in which diamond fine particles are dispersed. The fixing device 1' of this type has similar effects to those of the roller-type fixing device 1 as described above. Hereinafter, the configuration of the fixing device 1' of this modification will be described.

The fixing device 1' has a fixing belt 100, a driving roller 101, a driven roller 102, an exciting coil 103 as an induction heating device, and a pressurizing roller 105.

The fixing belt 100 includes a release layer 100*a* made of a polyimide film stacked on the outer side of a conductive layer 100*b* for generating an eddy-current by a magnetic flux generated by the exciting coil 103. The fixing belt 100 is wound on the driving roller 101 and the driven roller 102 and is driven in the direction of arrow R by the rotation of the driving roller 101.

The release layer 100*a* of the fixing belt 100 is made of a polyimide film in which diamond fine particles are dispersed. The diamond fine particles have an average particle diameter of 300 nm and are added and dispersed into the polyimide film release layer 100*a* at a rate of 3 wt %. The release layer 100*a* has a thickness of 30 μm.

The conductive layer 100*b* is a layer heated by the induction heating device, as described above. In this embodiment, the conductive layer 100*b* is formed by applying Ni on the polyimide film of the release layer 100*a*. The conductive layer 100*b* has a thickness of 20 μm. As the conductive layer 100*b*, other conductive materials such as silver and copper can be used.

The driving roller 101 is driven by a driving motor, not shown, to drive the fixing belt 100 in the direction of arrow R. The driven roller 102 is energized in the opposite direction to the driving roller 101 by a tension mechanism such as a tension spring, not shown, to provide a predetermined tensile force to the fixing belt 100. Thus, the fixing belt 100 can be driven without slipping on the driving roller 101.

The exciting coil 103 is an induction heating device which heats the fixing belt 100 in accordance with a principle similar to that of the exciting coil 11 as described above. That is, a high-frequency current is applied to the exciting coil 103 by an exciting circuit, not shown, and a magnetic flux is thus generated. This magnetic flux generates an eddy-current in the conductive layer 100*b* of the fixing belt 100. As the eddy-current is generated, the conductive layer 100*b* generates heat by electric resistance and heats the fixing belt 100.

The pressurizing roller 105 is a roller which forms a nip part N at a position where the pressurizing roller 105 faces the exciting coil 103 with the fixing belt 100 nipped between them. The pressurizing roller is pressed toward the side of the fixing belt 100 by a pressurizing mechanism, not shown, and, together with the fixing belt 100, forms the nip part N having a predetermined nip width. The pressurizing roller 105 may be either a rigid roller or a roller having an elastic layer.

In the fixing device 1', since diamond fine particles are dispersed in the polyimide film forming the release layer 100*a* of the fixing belt 100, wear resistance and thermal conductivity are improved. As wear resistance is improved, the thickness of the polyimide film of the fixing belt 100 can be reduced and its heat capacity can be reduced. Thus, warm-up time can be reduced. As the heat capacity is reduced, a temperature difference tends to occur between a part where a sheet is passed and apart where a sheet is not passed. However, since thermal conductivity is improved by the dispersion of diamond fine particles, such uneven temperature can be solved in a short time. Thus, in the fixing device 1' in this modification, uneven gloss and uneven color due to uneven temperature of the fixing belt 100 do not occur and satisfactory fixing can be carried out.

Second Embodiment

Figure 5:
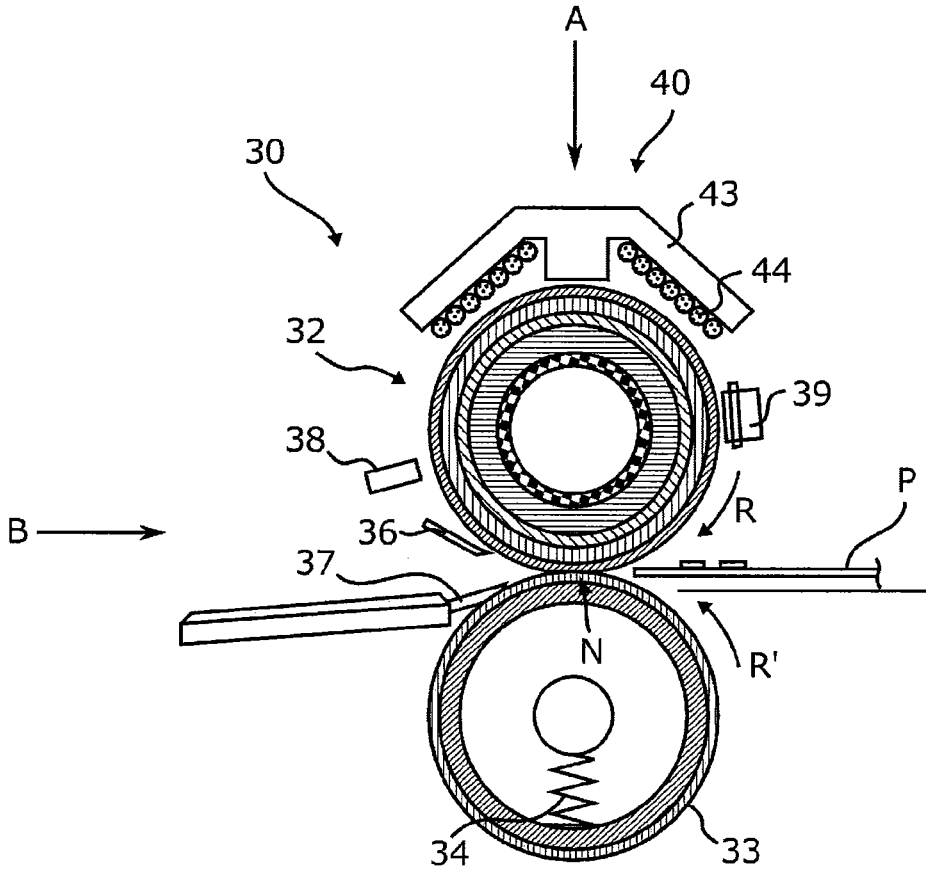
FIG. 5 is a sectional view of a fixing device according to a second embodiment.

Next, a second embodiment will be described. FIG. 5 is a sectional view of a fixing device 30 according to a second embodiment.

The fixing device 30 of this embodiment differs from the fixing device 1 of the first embodiment in that an induction heating device 40 for heating a fixing roller 32 is arranged not in the fixing roller 32 but outside of the fixing roller 32. Since the induction heating device 40 is outside of the fixing roller 32, the internal structure of the fixing roller 32 is different as well. The configuration similar to that of the fixing device of the first embodiment will not be described further in detail.

Hereinafter, the configuration of the fixing device 30 of the second embodiment will be described.

The fixing device 30 has a fixing roller 32, a pressurizing roller 33, a separator blade 36, a temperature detection unit 38, a thermostat 39, an induction heating device 40 and so on.

The fixing roller 32, similarly to the fixing roller of the first embodiment, melts toner by heat as a sheet P having unfixed toner adhering thereto is passed through a nip part N that is formed by the fixing roller 32 and the pressurizing roller 33 pressed in contact with the fixing roller 32. The melted toner is press-bonded and fixed to the sheet P by the pressure of the nip part N.

Figure 6:
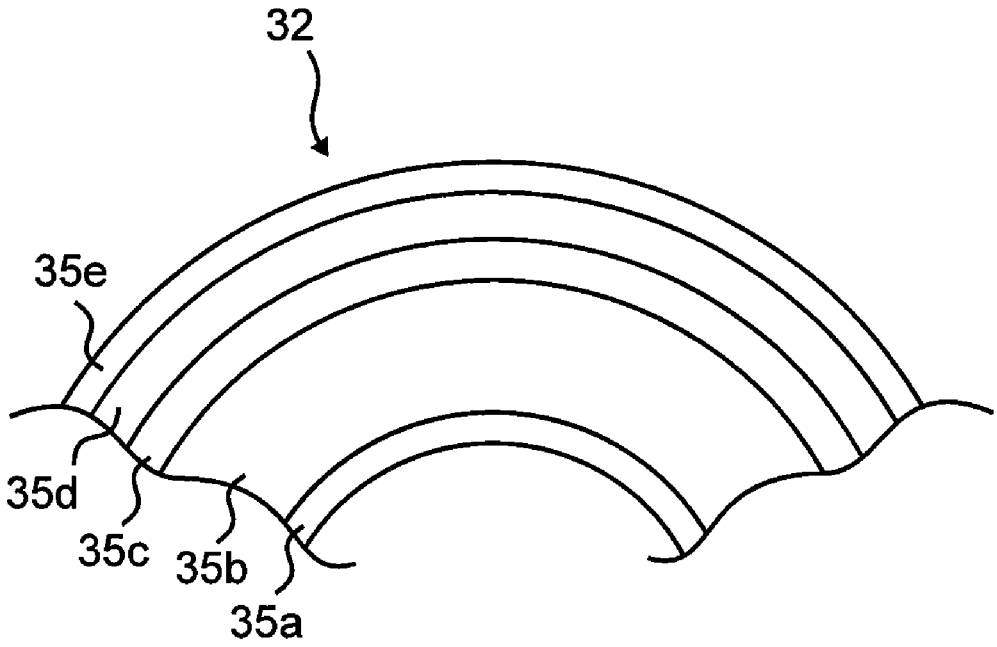
FIG. 6 is a partial sectional view of a fixing roller according to the second embodiment.

The configuration of the fixing roller 32 of this embodiment will be described with reference to FIG. 6. FIG. 6 is a partial sectional view of the fixing roller 32 of this embodiment. The fixing roller 32 includes a core metal 35*a*, a foam rubber layer 35*b*, a metal conductive layer 35*c*, an elastic layer 35*d* and a release layer 35*e*, stacked in order from the inner side.

The core metal 35*a* is a cylindrical core member made of stainless steel with a thickness of 2 mm.

The foam rubber layer 35*b* is made of foamed silicone sponge that is heat-insulating and heat-resistant. This foam rubber layer 35*b* is a layer to make the fixing roller 32 flexible so that a predetermined nip width can be formed between the fixing roller 32 and the pressurizing roller 33. Since the foam rubber layer 35*b* is heat-insulating, heat of the metal conductive layer 35*c* heated by the induction heating device 40 can be prevented from being transmitted to the inside of the fixing roller 32 and the thermal efficiency of the fixing roller 32 can be enhanced. The rubber hardness of the foam rubber layer 35*b* in this embodiment is 20 degrees as measured by an Asker C hardness tester.

The metal conductive layer 35*c* is a layer which generates heat by an eddy-current generated by a change in the magnetic flux generated from the induction heating device 40, and thus heats the fixing roller 32. The metal conductive layer 35*c* has the same function as the metal core 8 of the first embodiment. However, in this embodiment, since the exciting coil of the induction heating device 40 is provided outside of the fixing roller 32, the metal conductive layer 35*c* is provided separately from the core metal 35*a*. The metal conductive layer 35*c* in this embodiment is a Ni layer with a thickness of 40 μm.

The elastic layer 35*d* is a layer for adjusting the flexibility of the release layer 35*e* on the roller surface. As flexibility is adjusted by this layer, the surface of the fixing roller 32 accurately follows the concave-convex shape of the toner on the sheet P at the nip part N between the fixing roller and the pressurizing roller and can uniformly heat the toner. Since the toner is uniformly heated, the toner fixed to the sheet P has no uneven gloss and a satisfactory image can be formed.

The elastic layer 35*d* in this embodiment is a 200-μm thick layer made of silicone rubber in which diamond fine particles are dispersed. Since diamond fine particles having a high thermal conductivity are added, the thermal conductivity of the elastic layer 35*d* can be improved. The diamond fine particles have an average particle diameter of 300 nm and are dispersed in the elastic layer 35*d* at a rate of 3 wt %.

The release layer 35*e* is a layer similar to the release layer 7 of the first embodiment. The release layer 35*e* is a fluorine resin layer with a thickness of 5 μm in which diamond fine particles are dispersed.

As diamond fine particles are dispersed in this manner in the elastic layer 35*d* and the release layer 35*e*, the thermal conductivity of the elastic layer 35*d* and the release layer 35*e* can be improved, as described above. Moreover, as in the first embodiment, the wear resistance of the release layer 35*e* forming the surface of the fixing roller 32 can be improved as well.

On the other hand, if diamond fine particles are not dispersed, the elastic layer 35*d* and the release layer 35*e* have a low thermal conductivity and therefore it takes time for heat of the metal conductive layer heated by induction heating to reach the roller surface. If the output of the induction heating device 40 is increased in order to reduce the heating time, the temperature difference between the elastic layer 35*d* and the release layer 35*e*, and the metal conductive layer 35*c*, is increased because of the low thermal conductivity of the elastic layer 35*d* and the release layer 35*e*. This may cause separation of the adhesive layer between the metal conductive layer 35*c* and the elastic layer 35*d*. Therefore, it is difficult to reduce warm-up time.

However, in this embodiment, since the elastic layer 35*d* and the release layer 35*e* in which diamond fine particles are dispersed have the improved thermal conductivity, the temperature difference between the metal conductive layer 35*c*, and the elastic layer 35*d* and the release layer 35*e*, can be reduced. If the temperature difference is small, the separation of the adhesive layer can be prevented. The output of the induction heating device 40 can be increased and warm-up time can be reduced.

As diamond fine particles are dispersed in the elastic layer 35*d* and the release layer 35*e*, temperature unevenness in the circumferential direction and in the axial direction on the surface of the fixing roller 32 can be reduced.

Now, FIG. 7 shows the results of measuring the temperature of the release layer immediately before sheet passage and the temperature of the release layer at a position immediately before the sheet reaches the nip part again after sheet passage, in order to evaluate the temperature recovery performance in the circumferential direction with respect to the fixing roller 32 in this embodiment and a fixing roller having a conventional release layer (made only of a fluorine resin with a thickness of 50 μm) and a conventional elastic layer (made only of silicone rubber with a thickness of 200 μm).

As shown in FIG. 7, if the elastic layer 35*d* and the release layer 35*e* of this embodiment are provided, the fall from the temperature immediately before sheet passage to the temperature immediately before the sheet is passed again after the sheet is passed once is 3° C. Meanwhile, in the case of the conventional fixing roller having a release layer and an elastic layer to which diamond fine particles are not added, the temperature fall is 10° C.

In this manner, in the fixing roller 32 of this embodiment, the thermal conductivity of the elastic layer 35*d* and the release layer 35*e* is improved and temperature unevenness in the circumferential direction can be improved. Thus, uneven gloss and uneven color of the fixed toner due to temperature unevenness in the circumferential direction can be prevented and image quality can be improved.

Also, in the fixing roller 32 of this embodiment, since diamond fine particles are dispersed, temperature unevenness in the axial direction of the fixing roller 32 can be improved as well. As will be described later, in the induction heating device 40 of this embodiment, the exciting coil is divided into a coil 41 which heats the vicinity of the center of the fixing roller 32 and coils 42*a* and 42*b* which heat the vicinity of the edges, in order to control heat-generating areas of the fixing roller 32 and thus cope with continuous fixing to small-sized sheets. Therefore, parts corresponding to the connecting parts between the center coil 41 and the coils 42*a* and 42*b* at both ends of the fixing roller 32 cannot easily be heated. However, in the fixing roller 32 of this embodiment, thermal conductivity is improved, compared to the conventional fixing roller. Therefore, heat of the heated part easily spreads to the parts that cannot easily be heated, and temperature unevenness in the axial direction is reduced. Thus, even if the exciting coil is divided, uneven gloss is not generated in the toner fixed to the corresponding parts.

Meanwhile, the release layer 35*e* has the improved wear resistance and the improved thermal conductivity, its thickness can be reduced (in this embodiment, 5 μm). Thus, compared to the conventional case where the release layer 35*e* is thick (for example, 20 μm to 50 μm), flexibility of the roller surface is increased and heat is uniformly transmitted to toner. Therefore, image quality can be improved.

It is also preferable that the average particle diameter of diamond fine particles dispersed in the elastic layer 35*d* be 0.1 nm or greater and 500 nm or smaller. Diamond fine particles with diameters out of this range cannot be uniformly dispersed and are not preferable in terms of operability.

As the configuration of the other parts, the separator blade 36 for separating the sheet P from the fixing roller 32 is arranged downstream in the rotating direction R from the nip part N of the fixing roller 32. Moreover, a separator pawl 37 for separating the sheet P from the pressurizing roller 33 is arranged downstream in the rotating direction R' from the nip part of the pressurizing roller 33.

Figure 9:
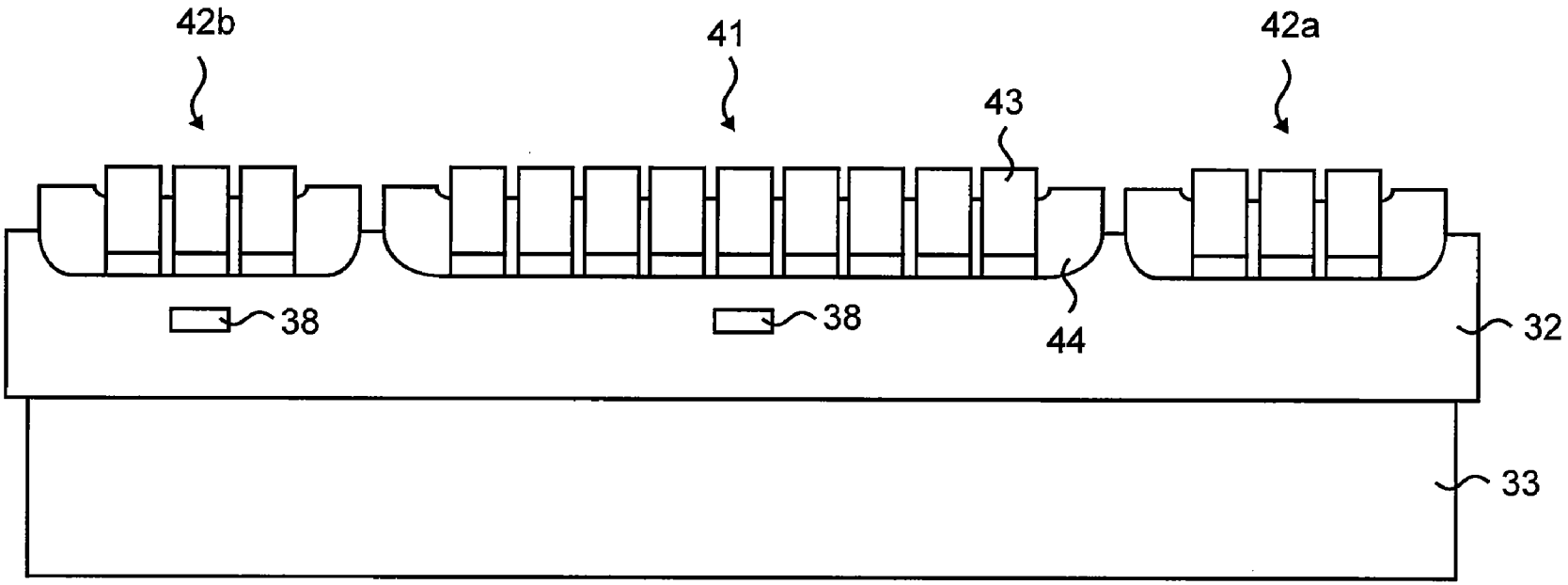
FIG. 9 is a front view of the induction heating device according to the second embodiment, as viewed from the direction of arrow B in FIG. 3.

Further downstream in the rotating direction R from the separator blade 36, the temperature detection device 38 which detects the temperature of the fixing roller 32 is arranged. In this embodiment, two temperature detection devices 38 are arranged in the axial direction of the fixing roller 32, as shown in FIG. 9, which will be described later. As the distribution of the surface temperature of the fixing roller 32 is detected by these temperature detection devices 38 and the output of the induction heating device 40 is adjusted, the temperature in the axial direction of the fixing roller 32 can be controlled.

Upstream in the rotating direction R from the nip part of the fixing roller 32 and to the side of the fixing roller, the thermostat 39 which detects anomaly in the surface temperature of the fixing roller 32 is arranged.

Figure 8:
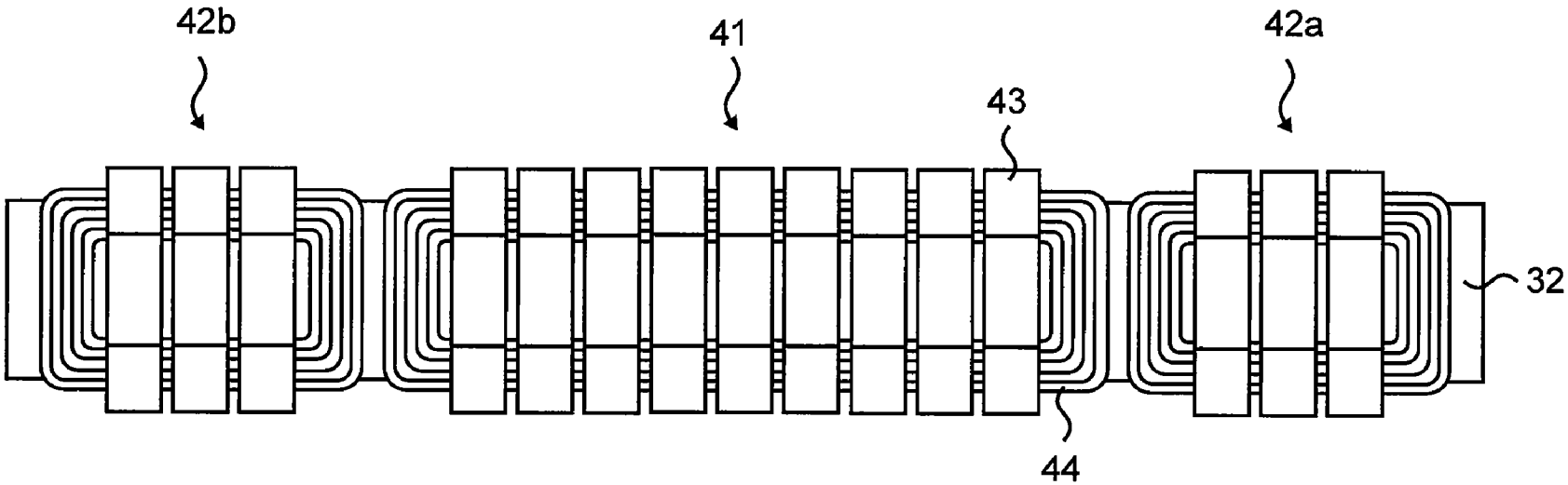
FIG. 8 is a plan view of an induction heating device according to the second embodiment, as viewed from the direction of arrow A in FIG. 3.

Next, the induction heating device 40 will be described with reference to FIG. 8 and FIG. 9. FIG. 8 is a plan view of the induction heating device 40 as viewed from the direction of arrow A in FIG. 5. FIG. 9 is a front view of the induction heating device 40 as viewed from the direction of arrow B in FIG. 5 (where the separator blade 36, the separator pawl 37 and the like are not shown). This induction heating device 40, similarly to the exciting coil of the first embodiment, is a device which generates a magnetic flux by using a coil and thereby causes the metal conductive layer 35*c* of the fixing roller 32 to generate heat, thus heating the roller, as described above. In this embodiment, the induction heating device 40 is installed above the fixing roller 32. The exciting coil of the induction heating device 40 is divided into the coil 41 which heats the vicinity of the center of the fixing roller 32 and the coils 42*a* and 42*b* which heat the vicinity of the edges. Its heating area can be changed in accordance with the size of the sheet that passes through the device. For example, if the length of the coil 41 in the longitudinal direction is made to correspond to the length of the short side of A4-R sheet, it is possible to apply a high-frequency current only to the coil 41 when A4-R sheets are continuously passed, and thus heat only the area on the fixing roller 32 corresponding to the coil 41. This can prevent rise in the temperature in the area on the fixing roller 32 where the sheet P is not passed.

The material of the electric wires of the coils 41, 42*a* and 42*b* of this embodiment is the same as that of the first embodiment. Additionally, in the induction heating device 40 of this embodiment, the coils are wound on magnetic cores 43 so that the coil property can sufficiently be achieved even if the number of turns of the electric wires of the coils is reduced. Each of the cores 43 has a width of 15 mm and the cores are arranged with a space of 5 mm between them. If the space between the cores is too large, it causes temperature unevenness in the axial direction of the fixing roller 32. Therefore, the space is 5 mm in this embodiment.

Similarly to the first embodiment, a high-frequency current is applied to this induction heating device 40 by an exciting circuit (inverter circuit), not shown, and a magnetic flux is thus generated.

In this manner, in the fixing device 30 of this embodiment, since diamond fine particles are dispersed in the elastic layer 35*d* and the release layer 35*e*, the thermal conductivity of the elastic layer 35*d* and the release layer 35*e* can be improved. The wear resistance of the release layer 35*e* can be improved as well.

Thus, the thickness of the release layer can be reduced. If the thickness of the layer is reduced, the surface of the fixing roller 32 can be reduced in hardness and made more flexible.

Therefore, heat is uniformly transmitted to toner and the image quality of a color image can be improved.

Also, since the reduced thickness of the release layer 35*e* enables reduction in heat capacity and the thermal conductivity of the elastic layer 35*d* and the release layer 35*e* is improved, warm-up time is shortened and temperature unevenness in the axial direction and the circumferential direction of the fixing roller 32 is reduced.

Moreover, the temperature difference between layers, for example, between the metal conductive layer 35*c* and the elastic layer 35*d* or the like, is reduced. Therefore, the output of the induction heating device 40 can be increased compared with the conventional device and thus, warm-up time can be reduced.

Third Embodiment

Figure 10:
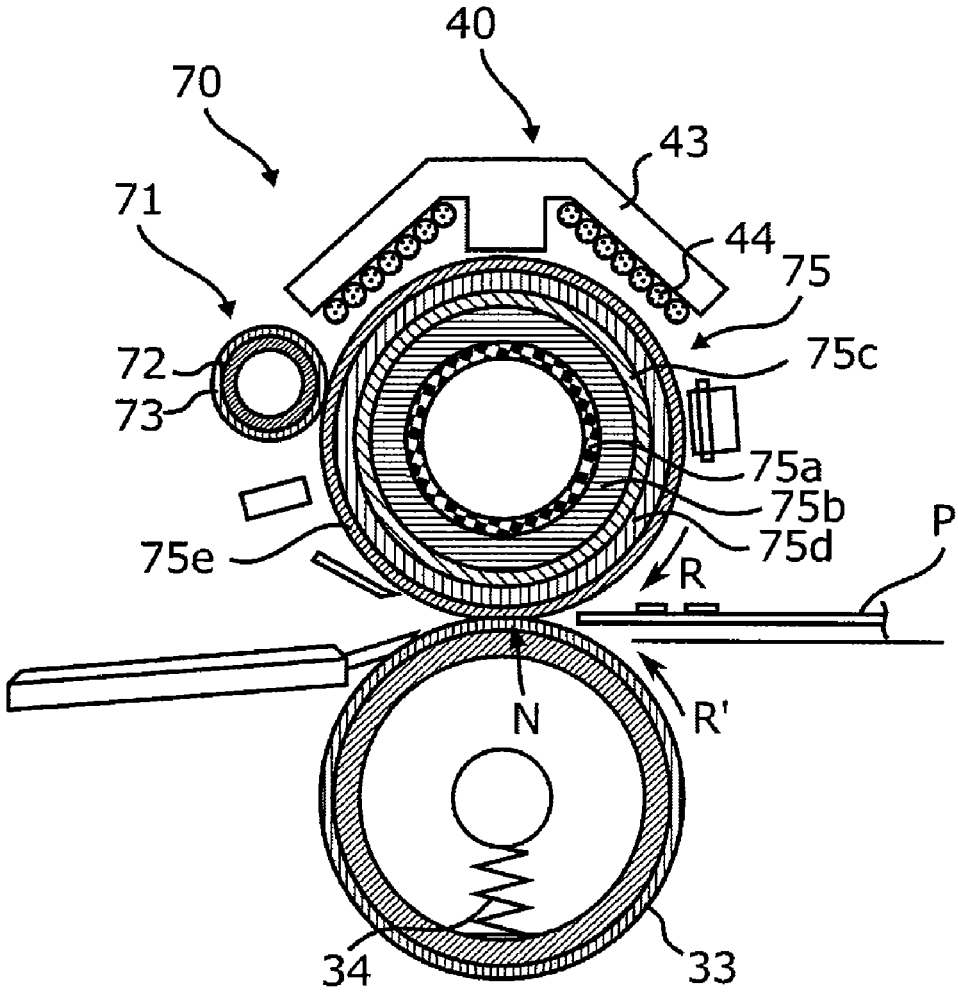
FIG. 10 is a sectional view of a fixing device according to a third embodiment.

Next, a third embodiment will be described. FIG. 10 is a sectional view of a fixing device 70 according to the third embodiment.

The fixing device 70 of the third embodiment differs from the above embodiments in that a temperature-uniforming roller 71 is provided and that diamond fine particles are dispersed in a layer forming the surface of the temperature-uniforming roller 71 instead of an elastic layer 75*d* and a release layer 75*e* of a fixing roller 75. Hereinafter, the configuration of the fixing device 70 of the third embodiment will be described. Similar parts to those of the first and second embodiments will not be described further in detail.

The temperature-uniforming roller 71 is a member which eliminates temperature unevenness mainly in the axial direction of the fixing roller 75. The temperature-uniforming roller 71 rotates by following fixing roller 75 and contacts the fixing roller 75, thus transferring heat from the fixing roller 75. Thus, heat transfer in the axial direction of the fixing roller 75 can be facilitated and temperature unevenness in the fixing roller 75 can be solved.

The temperature-uniforming roller 71 includes a core metal 72 and a release layer 73 stacked in order from the inner side.

The core metal 72 is a aluminum pipe with an outer diameter of 20 mm and a thickness of 2.5 mm.

The release layer 73 formed on the outer side of the core metal 72 is a layer for preventing a small amount of toner remaining on the surface of the fixing roller 75 from adhering to the temperature-uniforming roller 71. This release layer 73 is a 5-μm thick layer made of a fluorine resin in which diamond fine particles are dispersed. The diamond fine particles that are added have an average particle diameter of 300 nm and are dispersed in the release layer 73 at a rate of 3 wt %.

As diamond fine particles are dispersed in the release layer 73 of the temperature-uniforming roller 71, the thermal conductivity of the roller surface of the temperature-uniforming roller 71 can be enhanced. Thus, thermal conduction from the fixing roller 75 to the temperature-uniforming roller 71 occurs quickly and temperature unevenness in the fixing roller 75 can be effectively solved.

Meanwhile, if a release layer is not stacked on the temperature-uniforming roller and the core metal directly contacts the fixing roller, the core metal, which is made of a metal, has a high thermal conductivity and is highly effective in solving temperature unevenness in the fixing roller. However, a release layer is formed on the roller surface of the fixing roller and toner adheres more easily to the metal than the release layer. Therefore, if a release layer is not formed on the temperature-uniforming roller, remaining toner on the fixing roller adheres to and accumulates on the temperature-uniforming roller. In the part on the surface of the temperature-uniforming roller where the toner is accumulated, thermal conductivity is lowered. Consequently, the thermal conductivity of the temperature-uniforming roller is lowered and uneven heat transfer from the fixing roller 75 occurs, which is not preferable. Although a cleaning mechanism can be provided in order to remove the toner accumulated on the temperature-uniforming roller surface, the device is increased in size, which is not preferable. Thus, a release layer needs to be formed on the roller surface of the temperature-uniforming roller.

However, on the assumption that a release layer is provided on temperature-uniforming roller, if a release layer made only of a fluorine resin is provided, the release layer needs to have a thickness of approximately 15 μm to 50 μm in consideration of its wear due to contact with the fixing roller 75. Since a fluorine resin has a lower thermal conductivity than a metal, providing a release layer with such a thickness causes reduction in temperature-uniforming effect.

On the other hand, in the case of the temperature-uniforming roller 71 of this embodiment, since diamond fine particles are dispersed in the release layer 73 as described above, it is possible to form the release layer 73 with a high wear resistance and a thickness as thin as 5 μm. Moreover, since diamond fine particles have a high thermal conductivity and the thickness of the release layer 73 can be made as thin as 5 μm, the thermal conductivity of the temperature-uniforming roller 71 can be improved. Therefore, with the temperature-uniforming roller 71 of this embodiment, the temperature-uniforming effect on the fixing roller 75 can be significantly enhanced.

Also, since adherence of toner is prevented by the release layer 73, it is not necessary to provide any special cleaning mechanism for the temperature-uniforming roller 71. Thus, the fixing device 70 and an image forming apparatus having this fixing device can be reduced in size.

The configuration of other parts of this embodiment will be described.

The fixing roller 75 includes a core metal 75*a*, a foam rubber layer 75*b*, a metal conductive layer 75*c*, an elastic layer 75*d* and a release layer 75*e*. The basic configuration of the fixing roller 75 and the function of each layer are similar to those of the fixing roller 32 of the second embodiment. However, this embodiment differs from the second embodiment in that diamond fine particles are not dispersed in the elastic layer 75*d* and the release layer 75*e*.

The elastic layer 75*d* is a 200-μm thick layer made only of a silicone rubber.

The release layer 75*e* is a 30-μm thick layer made only of a fluorine resin. Since diamond fine particles are not dispersed in the release layer 75*e* of the fixing roller 75 in this embodiment, the release layer 75*e* is thicker than the release layer 35*e* (5 μm) of the second embodiment in consideration of wear.

In the fixing device 70 according to this embodiment as described above, the wear resistance and thermal conductivity of the temperature-uniforming roller 71 can be improved. With the improved thermal conductivity of the temperature-uniforming roller 71, temperature unevenness in the axial direction of the fixing roller 75 can effectively be solved even if diamond fine particles are dispersed in the release layer and the elastic layer of the fixing roller 75. Thus, uneven gloss and uneven color of toner fixed to the sheet P can be reduced and a high-quality image can be formed.

Fourth Embodiment

Figure 11:
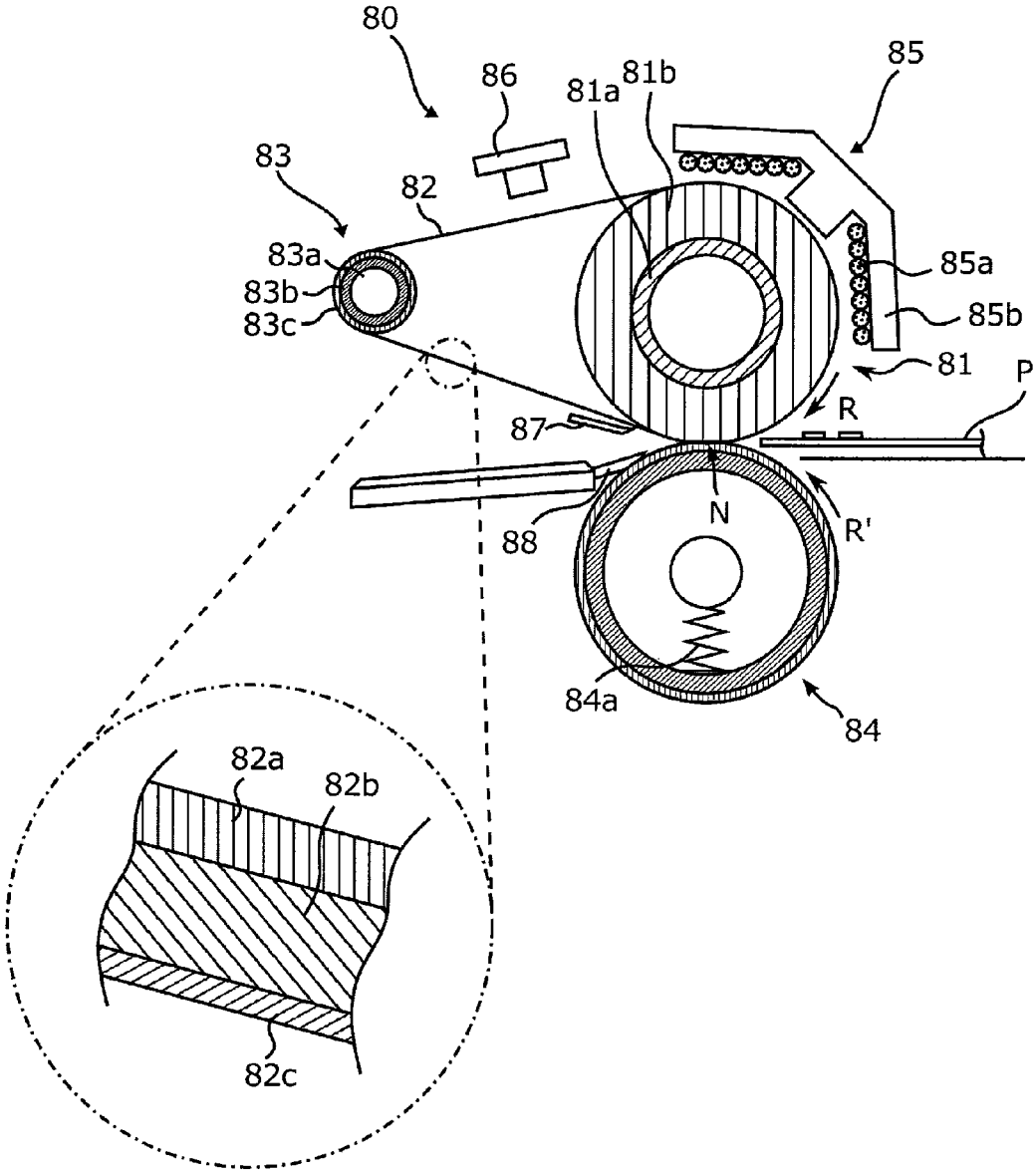
FIG. 11 is a sectional view of a fixing device according to a fourth embodiment.

Next, a fourth embodiment will be described. FIG. 11 is a sectional view of a fixing device 80 according to the fourth embodiment.

The fixing device 80 has a heating member including a fixing roller 81 and a fixing belt 82, a temperature-uniforming roller 83, a pressurizing roller 84, an induction heating device 85 as a heating unit, a thermopile 86, a separator blade 87, a separator pawl 88 and so on.

The fixing device 80 of this embodiment is a device which fixes toner to a sheet P by passing the sheet P to which unfixed toner is adhering, through a nip part N between the endless fixing belt 82 and the pressurizing roller 84.

Hereinafter, the configuration of each part of the fixing device 80 will be described with reference to FIG. 11.

First, the configuration related to the heating member which heats toner on the sheet P in order to fix the toner to the sheet P will be described. In the heating member of this embodiment, a metal conductive layer 82*a* of the fixing belt 82 is heated by a magnetic flux generated by the induction heating device 85, and this heat heats toner adhering to the sheet P passing through the nip part N where the fixing belt 82 and the pressurizing roller 84 are pressed in contact with each other.

The fixing roller 81 is a roller on which the fixing belt 82 is wound, together with the temperature-uniforming roller 83. The fixing roller 81 follows the pressurizing roller 84 driven by a motor, not shown, and turns the fixing belt 82 in the direction of arrow R. The fixing roller 81 in this embodiment has a diameter of 50 mm and has a 2-mm thick core metal 81*a* and a 5-mm thick foam rubber layer 81*b* stacked on the outside of the core metal 81*a*.

The fixing belt 82 is a heating member which heats and melts the toner on the sheet P by heat generated by the metal conductive layer 82*a* via the induction heating device 85. The fixing belt 82 is wound on the fixing roller 81 and the temperature-uniforming roller 83, with its predetermined tension maintained. The nip part N is formed at the position where the fixing belt 82 and the pressurizing roller 84 are pressed in contact with each other. The fixing belt 82 is formed by stacking the metal conductive layer 82*a*, an elastic layer 82*b* and a release layer 82*c*.

The metal conductive layer 82*a* is a layer which generates heat with an eddy-current generated by a change in the magnetic flux generated by the induction heating device 85 and thus heats the fixing belt 82. The metal conductive layer 82*a* is a 40-μm thick nickel layer. As the material of the metal conductive layer 82*a*, metals such as stainless steel, aluminum, or a composite material of stainless steel and aluminum, can be used as well as nickel.

The elastic layer 82*b* is a layer for making the fixing belt 82 flexible so that a predetermined nip width can be formed between the fixing belt 82 and the pressurizing roller 84. The elastic layer 82*b* in this embodiment is an elastic silicone rubber layer having a thickness of 200 μm.

The release layer 82*c* is a layer which forms the belt surface as the outer circumferential surface of the fixing belt and prevents toner from adhering to the fixing belt 82. The release layer 82*c* in this embodiment is a 50-μm thick PFA (tetrafluoroethylene perfluoro alkyl vinyl ether copolymer) layer. As its material, a fluorine resin such as PTFE (polytetrafluoroethylene) can also be used.

The temperature-uniforming roller 83 is a member which eliminates temperature unevenness in the axial direction of the fixing belt 82. The temperature-uniforming roller 83 contacts the fixing belt 82 to transfer heat from the fixing belt 82, and thus facilitates heat transfer in the axial direction of the fixing belt 82. Thus, temperature unevenness on the fixing belt 82 can be solved.

The temperature-uniforming roller 83 includes a heat pipe 83*a*, a metal pipe 83*b*, and a DLC layer 83*c* coated with diamond-like carbon (hereinafter referred to as DLC), stacked in order from the inner side.

The heat pipe 83*a* is a heat transfer member for uniforming the temperature difference in the axial direction of the temperature-uniforming roller 83. The heat pipe 83*a* is a copper heat pipe having an outer diameter of 16 mm.

The metal pipe 83*b* is an aluminum pipe having an outer diameter of 17 mm and a thickness of 0.5 mm. As its material, iron, copper, stainless steel or the like can be used.

Figure 12:
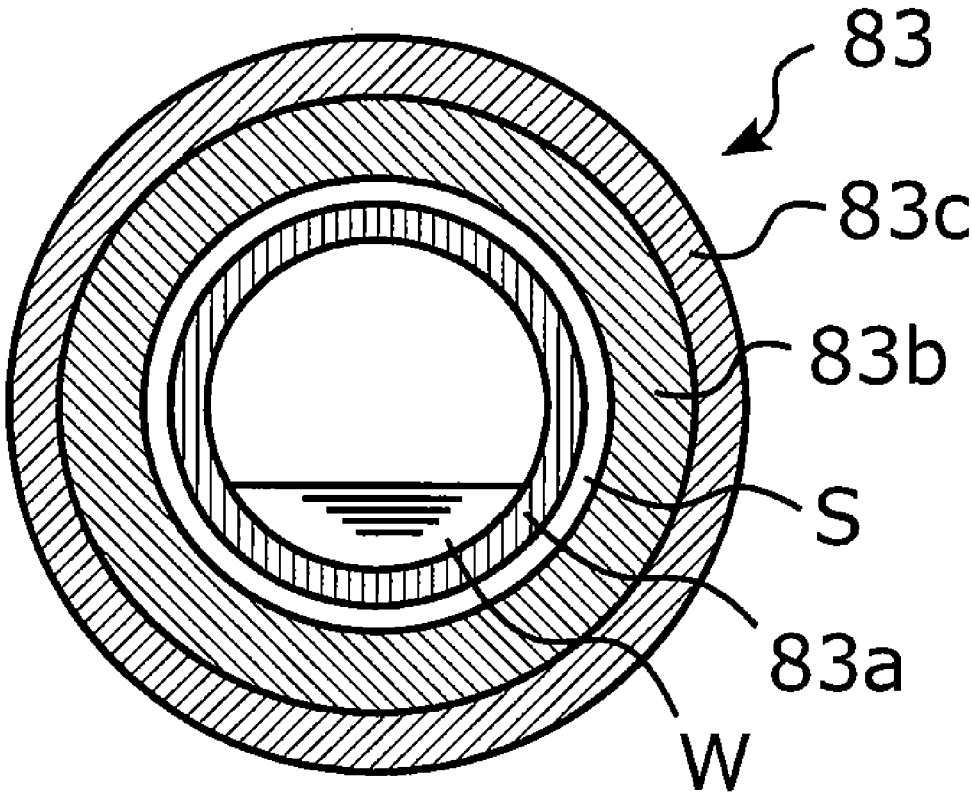
FIG. 12 is a sectional view of a temperature-uniforming roller.

In coupling the heat pipe 83*a* and the metal pipe 83*b*, the heat pipe 83*a* is inserted in the metal pipe 83*b* and heat is applied. FIG. 12 shows a sectional view of the state where the heat pipe 83*a* is inserted in the metal pipe 83*b* before heat is applied. Before heat is applied, there is a space S between the heat pipe 83*a* and the metal pipe 83*b*. As the temperature-uniforming roller 83 is heated to approximately 300° C. in this state, the heat pipe 83*a* and the metal pipe 83*b* expand in the direction of outer diameter. Since the two pipes have different coefficients of linear expansion, the space S is eliminated and the two pipes are coupled when normal temperatures are restored. By such coupling, the heat pipe 83*a* and the metal pipe 83*b* tightly contact each other without any space between them, and thermal contact resistance on the boundary between the two pipes can be reduced. Thus, the temperature difference generated in the axial direction of the metal pipe 83*b*, as transmitted from the fixing belt 82, is quickly transmitted to the heat pipe 83*a*. Heat is transmitted from a high-temperature part to a low-temperature part of the heat pipe 83*a* and the temperature is made uniform. This enables the temperature difference in the temperature-uniforming roller 83 to be uniform in the axial direction. Thus, with the temperature-uniforming roller 83 in this embodiment, temperature unevenness in the axial direction of the temperature-uniforming roller 83 generated in the fixing belt 82 can be quickly eliminated.

It is preferable that the heating temperature to eliminate the space S is 300° C. or lower in accordance with the heat resistance temperature of the heat pipe 83*a*. This is because if the heating temperature exceeds 300° C., air in the heat pipe 83*a* expands and can cause cracks in the pipe.

The DLC layer 83*c* is a layer for preventing the temperature-uniforming roller 83 from being worn by the contact with the fixing belt 82. As the DLC layer 83*c* in this embodiment, DLC is applied to a thickness of 1 μm on the surface of the metal pipe 83*b*. This DLC layer 83*c* is deposited by an ionized evaporation method in a high vacuum. The DLC is a hard film for modification of a material surface, containing carbon as its principal component. The DLC has a smooth surface structure and has excellent wear resistance. Therefore, as the DLC layer 83*c* is formed on the surface of the temperature-uniforming roller 83, the rotational slidability between temperature-uniforming roller 83 and the fixing belt 82 can be improved. Thus, the metal conductive layer 82*a* on the inner side of the fixing belt 82 and the surface of the temperature-uniforming roller 83 can be prevented from being worn. The DLC layer 83*c* has a thermal conductivity of approximately 40 W/mK, which is higher than the thermal conductivity of a fluorine resin (for example, approximately 0.5 to 0.8 W/mK in the case of PFA). Therefore, with the DLC layer 83*c*, wear resistance and slidability can be secured without lowering the excellent heat transfer capability of the temperature-uniforming roller 83.

Meanwhile, if the DLC layer 83*c* is not formed and the metal pipe 83*b* and the fixing belt 82 directly contact each other, an excellent temperature-uniforming effect is achieved because the metal pipe 83*b* made of a metal has a higher thermal conductivity than the DLC layer 83*c*. However, as the metal pipe 83*b* made of aluminum and the metal conductive layer 82*a* made of nickel on the inner side of the fixing belt 82 contact each other, the metal pipe 83*b* made of aluminum with a lower hardness becomes worn. Aluminum shaven off the metal pipe 83*b* adheres to the metal conductive layer 82*a*. However, if aluminum adheres to the metal conductive layer 82*a*, the magnetic coupling property between an exciting coil 85*a* of the induction heating device 85 and the fixing belt 82 changes. As the magnetic coupling property changes, mutual inductance changes, generating power variance or increasing the quantity of current flowing through the exciting coil 85*a*. Thus, induction heating efficiency may be lowered, which is not preferable. On the other hand, if the metal pipe 83*b* is made of a metal having a higher hardness than nickel, the metal conductive layer 82*a* becomes worn, which is not preferable.

If a fluorine resin layer such as PFA is formed on the surface of the temperature-uniforming roller, wear due to the contact between metals can be prevented and good slidability is realized as well. However, if a fluorine resin layer or the like is used, the thermal conductivity is low as described above and the temperature-uniforming effect of the temperature-uniforming roller is lowered. This is not preferable.

Figure 13:
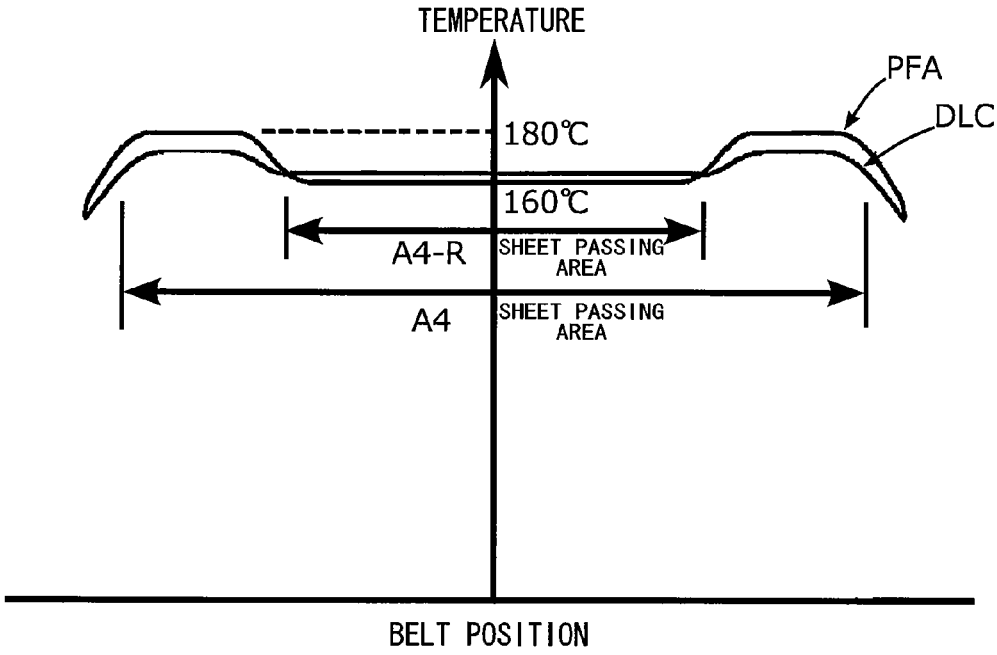
FIG. 13 is a graph showing temperature distribution on a fixing belt.

Now, FIG. 13 shows temperature distribution on the fixing belt 82 in the case where A4-R sheets having a smaller width than the length of the fixing belt 82 in the axial direction of the temperature-uniforming roller 83 are continuously passed through the fixing device 80 for fixing. DLC in FIG. 13 indicates temperature distribution on the fixing belt 82 having the DLC layer 83*c* of this embodiment. PFA indicates temperature distribution of a fixing belt with a fluorine resin layer formed on its surface. From the graph of FIG. 13, it can be understood that the fixing belt 82 of this embodiment has a smaller temperature difference between an A4-R sheet passing area and an A4-R non-passing area. Therefore, with the temperature-uniforming roller 83 of this embodiment, the temperature of the fixing belt 82 can effectively be made uniform. Meanwhile, in the case of the fluorine resin layer, heat transfer efficiency from the fixing belt to the temperature-uniforming roller is lower than in this embodiment. Therefore, there is a greater temperature difference between the sheet passing area and the non-passing area, and the heat transfer capability of the temperature-uniforming roller cannot be fully utilized.

Another advantage of providing the DLC layer 83*c* on the temperature-uniforming roller 83 is that the DLC layer 83*c* can be formed at a lower temperature than the heat resistance temperature of the heat pipe 83*a*. The DLC layer is deposited by an ionized evaporation method in a high vacuum and the temperature at the time of deposition is usually 200° C. or lower. Since the heat resistance temperature of the heat pipe 83*a* is approximately 300° C. as described above, the DLC layer can be formed at a lower temperature than the heat resistance temperature. Therefore, even if DLC coating is carried out in the state where the heat pipe 83*a* is inserted in the metal pipe 83*b*, no crack is generated in the heat pipe 83*a*. Meanwhile, if a fluorine resin layer is provided as the roller surface layer, the temperature of the fluorine resin coating process is usually 380° C. Therefore, cracks may be generated in the heat pipe 83*a*, which is not preferable.

It is preferable that the DLC layer 83*a* has a thickness of 1 μm or greater and 5 μm or smaller. This is because a thickness of 1 μm or greater is preferable to secure wear resistance, whereas a thickness of 5 μm or greater lowers the heat transfer capability of the temperature-uniforming roller.

Next, the pressurizing roller 84 is pressed in contact with the fixing belt 82 between the pressurizing roller 84 and the fixing roller 81 by a pressurizing mechanism 84*a* in order to maintain a predetermined nip width between the pressurizing roller 84 and the fixing belt 82. The pressurizing roller 84 nips and carries the sheet P in collaboration with the belt surface. This pressurizing roller 84 is rotationally driven in the direction of arrow R' by a driving motor, not shown. Thus, the fixing belt 82 and the fixing roller 81 follow the pressurizing roller 84 and turn in the direction of arrow R. As the sheet P is passed through the nip part N between the pressurizing roller 84 and the fixing belt 82, toner melted by the fixing belt 82 is press-bonded to the sheet P by the pressure from the pressurizing roller 84.

The pressurizing roller 84 in this embodiment has a diameter of 50 mm and includes a core metal with its circumference coated with a silicone rubber or a fluorine rubber or the like. The silicone rubber or fluorine rubber layer functions as an elastic layer. As the pressurizing roller 84 is pressed in contact with the fixing belt 82 and the fixing roller 81, the roller surface is deformed, thus forming a predetermined nip width. Thus, heat of the fixing roller can be securely transmitted to the toner on the passing sheet P and satisfactory fixing is carried out.

The induction heating device 85 has an exciting coil 85*a* and a magnetic core 85*b* and is arranged on the outer periphery of the fixing belt 82. In this induction heating device 85, a magnetic flux is generated by a high-frequency current applied to the exciting coil 85*a* from an exciting circuit (inverter circuit), not shown. Then, an eddy-current is generated in the metal conductive layer 82*a* of the fixing belt 82 by a change in the magnetic flux, and the metal conductive layer 82*a* having the eddy-current generated therein generates heat by electric resistance. This heat generation of the metal conductive layer 82*a* enables the fixing belt 82 to be heated.

The exciting coil 85*a* is formed by winding a Litz wire, which is a bundle of plural copper wires each having a diameter of 0.5 mm and having its surface coated with an insulating film. As the Litz wire in this embodiment, a bundle of 16 copper wires coated with heat-resistant polyamideimide as an insulating material is used. As the Litz wire is used, the diameter of the coil wires can be made smaller than the penetration depth of the current and the AC current can effectively be applied.

In this embodiment, a high-frequency current within a range of 20 to 100 kHz can be applied to the exciting coil 85*a*. The output of the induction heating device 85 can be adjusted within a range of 200 W to 1500 W by adjustment of the driving frequency of the exciting circuit, not shown.

The thermopile 86 detects the temperature of the fixing belt 82. On the basis of the temperature of the fixing belt 82 detected by the thermopile 86, the current from the exciting circuit is adjusted and the temperature of the fixing belt 82 can be controlled. Thus, the temperature of the fixing belt 82 is maintained to a temperature necessary for fixing toner.

The separator blade 87 and the separator pawl 88 are members that are arranged downstream from the nip part in the carrying direction of the sheet P and separate the sheet P from the fixing belt 82 and the pressurizing roller 84, respectively.

In the fixing device 80 according to this embodiment, since the DLC layer 83*c* is formed on the temperature-uniforming roller 83, the excellent wear resistance and slidability of the DLC layer 83*c* prevents wear and shaving of the roller surface of the temperature-uniforming roller 83 and the metal conductive layer 82*a* of the fixing belt 82. Moreover, since the DLC layer 83*c* has a high thermal conductivity, there is little increase in thermal contact resistance between the temperature-uniforming roller 83 and the fixing belt 82 due to the provision of the DLC layer 83*c*. Therefore, wear resistance can be improved without deteriorating the heat transfer capability of the temperature-uniforming roller 83. Thus, temperature unevenness on the fixing belt can effectively be reduced and fixing with high image quality without uneven gloss or uneven color can be realized.

Moreover, the coating temperature of the DLC layer 83*c* is 300° C. or lower, which is equal to or lower than the heat resistance temperature of the heat pipe 83*a* of the temperature-uniforming roller 83. Therefore, there is no damage to the heat pipe in coupling the two parts.

In this embodiment, it is described that the DLC layer 83*c* is formed on the roller surface of the temperature-uniforming roller 83. However, the coating is not limited to this. Any material having a lower temperature in coating than the heat resistance temperature of the heat pipe and having high wear resistance and thermal conductivity can be used instead of the DLC layer 83*c*. For example, a TUFRAM (trademark registered) coating may be formed by a TUFRAM process. The TUFRAM coating is hard and excellent in mechanical strength. The TUFRAM coating is formed by combining hard alumite having many fine concave-convex parts such as micro cracks with a very small fluorine resin by the TUFRAM process.

The TUFRAM coating is a high-functional composite coating that achieves both effects of hard alumite and fluorine resin, and has mechanical characteristics including improved wear resistance, improved slidability, abrasion prevention, and reduction in stick slip. The processing temperature is 100° C. or lower, which poses no problem to the heat resistance of the heat pipe. In the case of the TUFRAM process, aluminum is used for the temperature-uniforming roller, as in this embodiment. As the TUFRAM coating is formed to a thickness of 20 μm, sufficient life performance can be secured for the temperature-uniforming roller.

Although the heat pipe is inserted in the temperature-uniforming roller 83 in this embodiment, the DLC layer or the TUFRAM coating may be formed on the outer side of a single metal pipe.

The invention can be carried out in various other forms without departing from the spirit and scope of the invention. Therefore, the above embodiments are simply exemplars in all respects and should not be interpreted as limiting the invention. The scope of the invention is defined by the attached claims and is not limited by the description of the specification. Moreover, all modifications that fall within a range equivalent to the claims, and various modifications, improvements and changes are within the scope of the invention.

As described above in detail, according to the invention, a technique of reducing temperature unevenness in a heating member which heats a heating target member while reducing heat capacity of the heating member in a fixing device for an image forming apparatus can be provided.

What is claimed is:

1. A fixing device comprising:

a temperature-uniforming roller having, on its outer surface, at least a layer containing a diamond-like carbon;

a fixing roller;

an endless fixing belt which is wound on the temperature-uniforming roller and the fixing roller and has its belt surface moved by rotation of the fixing roller;

a pressurizing roller which nips the fixing belt with the fixing roller and presses the belt surface of the fixing belt and nips and carries a sheet in collaboration with the belt surface; and a heating unit which is arranged to face the fixing roller through the fixing belt and heats the fixing belt.

2. The device according to claim 1, wherein the fixing belt has a metal conductive layer on its surface contacting the temperature-uniforming roller.

3. The device according to claim 2, wherein the conductive layer is heated by electromagnetic induction heating.

4. The device according to claim 1, wherein the layer containing the diamond-like carbon has a thickness of 1 μm or greater and 5 μm or smaller.

5. The device according to claim 1, wherein the temperature-uniforming roller has a heat pipe provided inside.

6. The device according to claim 5, wherein the heat pipe is made of copper.

7. The device according to claim 5, wherein the temperature-uniforming roller has a metal pipe provided outside.

8. The device according to claim 7, wherein the heat pipe is provided on the inside of the metal pipe.

9. The device according to claim 8, wherein the heat pipe tightly contacts with the inner surface of the metal pipe.

10. The device according to claim 9, wherein the metal pipe is made of aluminum.

11. The device according to claim 10, wherein the heat pipe is made of copper.

12. The device according to claim 5, wherein the diameter of the temperature-uniforming roller is smaller than that of the fixing roller.

13. The device according to claim 5, wherein the heating unit is arranged to cover the fixing roller through the fixing belt.

14. The device according to claim 5, wherein the heating unit is a induction heating device.

* * * * *